US006146282A

United States Patent [19]

McCready et al.

[11] Patent Number: 6,146,282

[45] Date of Patent: Nov. 14, 2000

[54] WATER SLIDE SYSTEM

[76] Inventors: Scott K. McCready; Dawn R. McCready, both of 107 Santa Fe Ct., Elyria, Ohio 44035

[21] Appl. No.: 09/406,937

[22] Filed: Sep. 28, 1999

[51] Int. Cl.[7] ..... A63G 21/18

[52] U.S. Cl. ..... 472/117; 472/116

[58] Field of Search ..... 472/89, 90, 116, 472/117, 128

[56] References Cited

U.S. PATENT DOCUMENTS

| | | | |
|---|---|---|---|
| 4,762,316 | 8/1988 | Merino | 472/117 |
| 4,813,663 | 3/1989 | Rice | 472/116 |
| 4,887,811 | 12/1989 | Tresh | 472/116 |
| 5,427,574 | 6/1995 | Donnelly-Weide | 472/116 |

*Primary Examiner*—Kien T. Nguyen
*Attorney, Agent, or Firm*—Michael S. Neustel

[57] ABSTRACT

A water slide system for easily converting a conventional backyard slide into a water slide. The inventive device includes an upper sheet formed to fit within the backyard slide, a pair of securing straps secured to the upper sheet for securing to the backyard slide, a pair of water tubes having a plurality of nozzles secured to opposing edges of the upper sheet for dispensing water upon the upper sheet, a transition member having a downwardly angled side, and a lower sheet. The lower portion of the upper sheet is securable to the transition member by a plurality of lengths of fasteners such as hook and loop fasteners. A plurality of gripping members are also provided for being secured to the steps of the ladder for preventing an individual from slipping within the wet environment. A plurality of securing loops are attached to the transition member and the lower sheet for receiving a plurality of stakes that are engageable within the ground surface. The upper sheet and the lower sheet are constructed of a plastic material that becomes extremely slippery when water is applied to the exterior surface. The transition member is comprised of an encasement and a plurality of spacer members thereby allowing adjustment of the vertical elevation of the transition member to fit various heights of backyard slides. Each of the spacer members has an angled edge for providing a smooth transition to the lower sheet from the upper sheet.

19 Claims, 2 Drawing Sheets

WATER SLIDE SYSTEM

BACKGROUND OF THE INVENTION

1. Field of the Invention

The present invention relates generally to water slides and more specifically it relates to a water slide system for easily converting a conventional backyard slide into a water slide.

Backyard slides are a common object in the backyards of houses, especially where children reside. Backyard slides generally comprise a ladder with a downwardly angled slide portion extending from the upper end of the ladder wherein individuals can slide down upon. Unfortunately, conventional backyard slides are not as suitable for utilization as a water slide. Hence, there is need for an assembly that converts a conventional backyard slide into a fun to utilize water slide.

2. Description of the Prior Art

Ground level water slides for children and adults have been utilized for many years. An example of one such device is the "Wham-O Slip n'Slide," which is disclosed in U.S. Pat. No. 2,982,547. Additional related patents include U.S. Pat. No. 5,154,671 to Smollar et al and U.S. Pat. No. 5,676,602 to Katz et al.

The first ground level water slides were an elongated strip of plastic spread along the ground and wet down with a conventional garden hose. Other devices included a means for securing to the ground surface along with a built in sprinkler system that delivered water to the plastic sheet from a conventional garden hose. The individual would run toward the strip of plastic and belly flop onto it. The individual's inertia causes the individual to slide over the surface of the sheet. Water upon the plastic sheet significantly reduces the friction thereby allowing the individual to achieve significant distances from a simple run.

Later versions of the water slide sheet included a sprinkler as part of the sheet, functioning enhanced using a perforated tube positioned lengthwise along one or both edges of the sheet. A more elaborate variation of the same idea is the "Wet Banana"™ slide manufactured by Koki, Inc. It has a rectangular plastic sheet, metal brackets to attach the plastic sheet to the ground, and a "Banana" sprinkler that is curved and has water emission holes positioned along the curves so that the water spray covers an area of the plastic sheet.

Other classes of aquatic toys include specialty water slides manufactured for pool and amusement park use featuring a long slide extending down a hill or otherwise elevated typically 25–30 feet high. These specialty water slides require pools, water filled areas and a relatively large area to function.

Existing water slides may also use flexible material laid only on the ground and covered with a thin layer of water to decrease friction in order to enable an individual to slide across the material. There are various means for attaching the material to the ground and for supplying a constant layer of water onto that surface. Existing ground-based plastic sheets designed for sliding cannot be adopted for use with a backyard slide.

While these devices may be suitable for the particular purpose to which they address, they are not as suitable for easily converting a conventional backyard slide into a water slide. Conventional backyard slides do not allow individuals to utilize them as a water slide. In addition, conventional water slide sheets that are spread upon a ground surface do not provide the thrill of playing upon an elevated water slide.

In these respects, the water slide system according to the present invention substantially departs from the conventional concepts and designs of the prior art, and in so doing provides an apparatus primarily developed for the purpose of easily converting a conventional backyard slide into a water slide.

SUMMARY OF THE INVENTION

In view of the foregoing disadvantages inherent in the known types of slides and water sheets now present in the prior art, the present invention provides a new water slide system construction wherein the same can be utilized for easily converting a conventional backyard slide into a water slide.

The general purpose of the present invention, which will be described subsequently in greater detail, is to provide a new water slide system that has many of the advantages of the slides and water sheets mentioned heretofore and many novel features that result in a new water slide system which is not anticipated, rendered obvious, suggested, or even implied by any of the prior art slides and water sheets, either alone or in any combination thereof.

To attain this, the present invention generally comprises an upper sheet formed to fit within the backyard slide, a pair of securing straps secured to the upper sheet for securing to the backyard slide, a pair of water tubes having a plurality of nozzles secured to opposing edges of the upper sheet for dispensing water upon the upper sheet, a transition member having a downwardly angled side, and a lower sheet. The lower portion of the upper sheet is securable to the transition member by plurality of lengths of fasteners such as hook and loop fasteners. A plurality of gripping members are also provided for being secured to the steps of the ladder for preventing an individual from slipping within the wet environment. A plurality of securing loops are attached to the transition member and the lower sheet for receiving a plurality of stakes that are engageable within the ground surface. The upper sheet and the lower sheet are constructed of a plastic material that becomes extremely slippery when water is applied to the exterior surface. The transition member is comprised of an encasement and a plurality of spacer members thereby allowing adjustment of the vertical elevation of the transition member to fit various heights of backyard slides. Each of the spacer members has an angled edge for providing a smooth transition to the lower sheet from the upper sheet.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a water slide system that will overcome the shortcomings of the prior art devices.

Another object is to provide a water slide system that allows an individual to easily convert an existing backyard slide into a fun to utilize water slide.

An additional object is to provide a water slide system that provides a slick surface for individuals to slide upon.

A further object is to provide a water slide system that are attachable to most conventional backyard slides.

Another object is to provide a water slide system that provides a thrilling ride for individuals.

A further object is to provide a water slide system that simulates a large water park slide within a backyard environment.

An additional object is to provide a water slide system that requires little effort by the user to utilize.

Another object is to provide a water slide system that provides a longer ride experience for the individual.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 2:
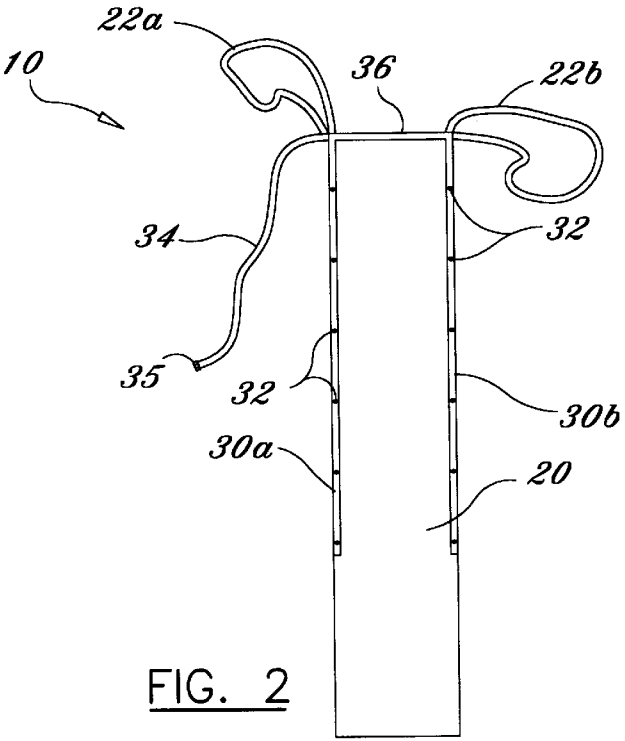
FIG. 2 is a top view of the upper sheet.

Turning now descriptively to the drawings, in which similar reference characters denote similar elements throughout the several views, FIGS. 1 through 5 illustrate a water slide system 10, which comprises an upper sheet 20 formed to fit within the backyard slide 12, a pair of securing straps 22*a–b* secured to the upper sheet 20 for securing to the backyard slide 12, a pair of water tubes 30*a–b* having a plurality of nozzles 32 secured to opposing edges of the upper sheet 20 for dispensing water upon the upper sheet 20, a transition member 40 having a downwardly angled side, and a lower sheet 50. The lower portion of the upper sheet 20 is securable to the transition member 40 by plurality of lengths of fasteners such as hook and loop fasteners. A plurality of gripping members 60 are also provided for being secured to the steps 14 of the ladder 14 for preventing an individual from slipping within the wet environment. A plurality of securing loops 42 are attached to the transition member 40 and the lower sheet 50 for receiving a plurality of stakes 44 that are engageable within the ground surface. The upper sheet 20 and the lower sheet 50 are constructed of a plastic material that becomes extremely slippery when water is applied to the exterior surface. The transition member 40 is comprised of an encasement 41 and a plurality of spacer member 45 thereby allowing adjustment of the vertical elevation of the transition member 40 to fit various heights of backyard slides 12. Each of the spacer member 45 has an angled or curved edge 47 for providing a smooth transition to the lower sheet 50 from the upper sheet 20.

Figure 1:
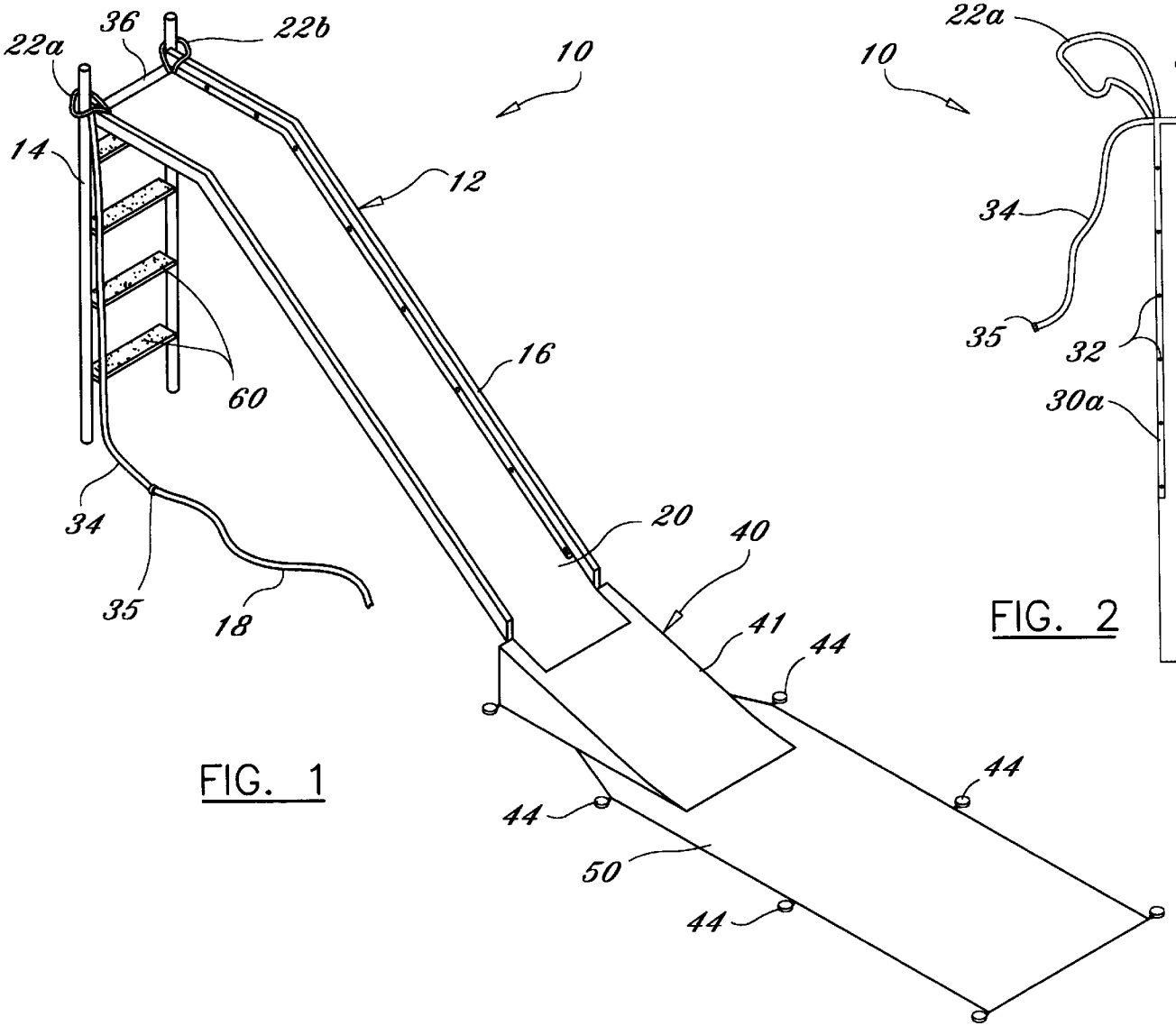
FIG. 1 is an upper perspective view of the present invention attached to a conventional backyard slide.

As shown in FIG. 1 of the drawings, a conventional backyard slide 12 generally comprises a frame having a plurality of steps 14 along with a downwardly angled portion 16. The angled portion 16 generally has a pair of opposing sides for preventing an individual from straying off the angled portion 16. The angled portion 16 has an upper portion and a lower portion which generally are 5 to 12 feet in length as shown in FIG. 1 of the drawings.

When utilizing a conventional backyard slide 12, an individual typically climbs upon the plurality of steps 14 upwardly to the angled portion 16. The individual then allows the downward force of gravity to pull them along the angled portion 16 until they are dispensed from the lower portion of the angled portion 16. Since the angled portion 16 is generally comprised of a metal or plastic material, applying water to the angled portion 16 will not significantly decrease the friction of the angled portion 16.

As best shown in FIGS. 1 and 2 of the drawings, the upper sheet 20 is an elongated structure formed to fit within the opposing side walls of the angled portion 16 of the backyard slide 12. The elongated upper sheet 20 is preferably longer than the angled portion 16 of the backyard slide 12 to overlap upon the transition member 40.

The elongated upper sheet 20 is preferably comprised of a flexible plastic material which becomes very slippery when a fluid such as water is applied thereto. The elongated upper sheet 20 may be comprised of virgin polyethylene with a slip additive within. The upper sheet 20 may also be comprised of various blends of elastomer materials mixed within the polyethylene in order to improve its strength and resistance to tearing under various types of stresses. The upper sheet 20 could also be comprised of a vinyl material.

Figure 3:
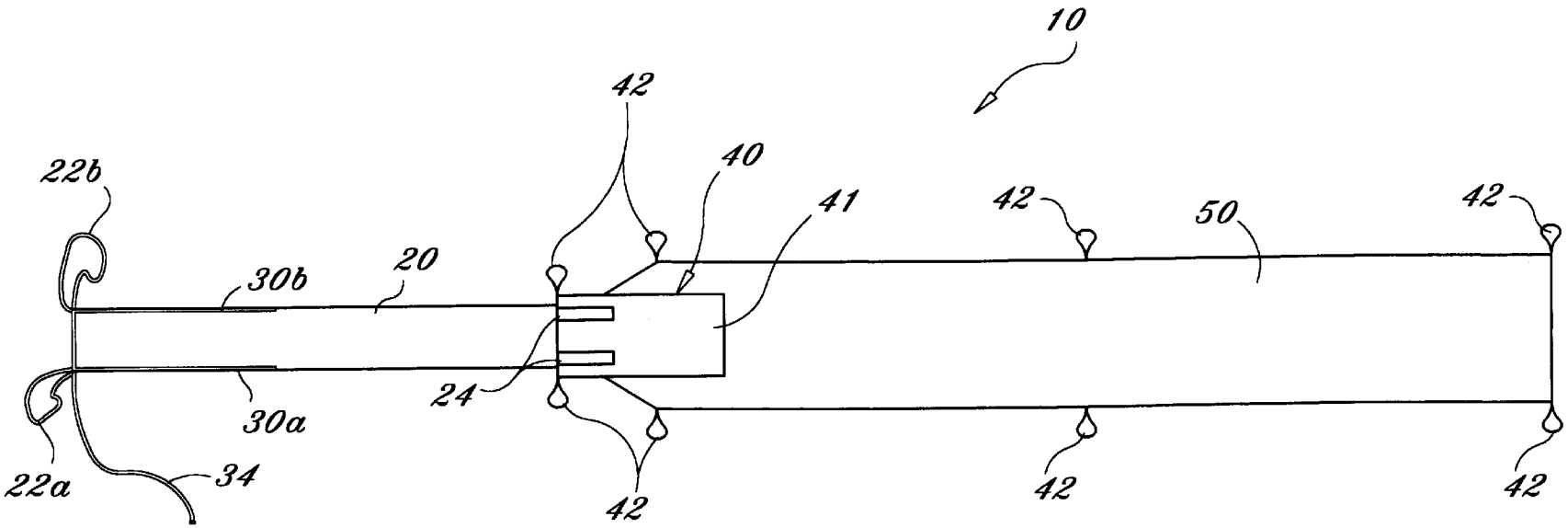
FIG. 3 is a top view of the present invention fully extended.

As shown in FIGS. 1 through 3 of the drawings, at least one securing strap 22*a* or 22*b* is attached to the upper portion of the upper sheet 20. As shown in FIGS. 1 through 3 of the drawings, there are preferably two securing straps 22*a–b* attached to opposing corners of the upper sheet 20 for allowing removable attachment to handles or posts of the backyard slide 12 thereby preventing the upper sheet 20 from moving upon the angled portion 16 of the backyard slide 12. The securing straps 22*a–b* may utilize any well-known fastener such as hook and loop or they simply may be tied upon the backyard slide 12.

As shown in FIGS. 1, 2 and 3 of the drawings, at least one water tube 30*a* or 30*b* is provided that is secured to a portion of the upper sheet 20. As shown in FIGS. 1, 2 and 3 of the drawings, there are preferably two water tubes 30*a–b* attached to opposing sides of the upper sheet 20.

Each of the water tubes 30*a–b* includes a plurality of nozzles 32 directed toward the central portion of the upper sheet 20 for dispensing a stream of fluid such as water upon the upper sheet 20 thereby decreasing the frictional resistance of the upper sheet 20 when a user slides upon it. It can be appreciated by one skilled in the art that the plurality of nozzles 32 may direct the fluid at various angles with respect to the upper sheet 20.

As shown in FIGS. 1 and 2, a cross tube 36 is fluidly connected between the water tubes 30*a–b*. The cross tube 36 is preferably attached to a rear edge of the upper sheet 20. It can be appreciated by one skilled in the art that the cross tube 36 may include a plurality of nozzles 32 for dispensing water along the longitudinal axis of the upper sheet 20. It can also be appreciated by one skilled in the art that the cross tube 36 may be the only tube utilized for dispensing water upon the upper sheet 20 instead of the pair of water tubes 30*a–b*.

As shown in FIG. 1 of the drawings, a delivery hose 34 is fluidly connected to either the cross tube 36 or one of the water tubes 30*a–b* for delivering water to the tubes 30, 36. The delivery hose 34 includes a coupler 35 for allowing removable connection to any conventional water hose 18 commonly called a "garden hose".

Figure 4:
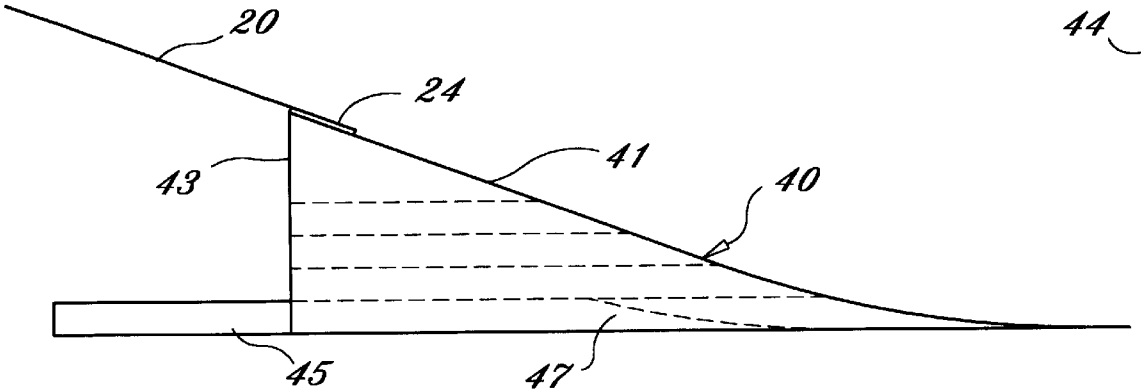
FIG. 4 is a magnified side view of the transition member.

As shown in FIGS. 1, 3 and 4 of the drawings, a transition member 40 is provided that is positionable below the lower portion of the upper sheet 20 and the angled portion 16 for providing a smooth transition of an individual from the upper sheet 20 during operation. The transition member 40 preferably has an angled side or curved side which the individual slides upon to enter the lower sheet 50. At least one fastener 24 is attached between the underside of the upper sheet 20 and the transition member 40 for allowing attachment of the upper sheet 20 to the transition member 40.

As shown in FIG. 4 of the drawings, the transition member 40 is preferably comprised of an encasement 41 with a rear opening 43. A plurality of spacer members 45 are positionable within the encasement 41 for allowing adjustment of the angle and height of the transition member 40 depending upon the height of the backyard slide 12. The plurality of spacer member preferably have an angled edge 47 or curved edge for providing a gradual transition to the lower sheet 50 as shown in FIG. 4 of the drawings. A plurality of securing loops 42 are attached to the encasement 41 for receiving a corresponding number of stakes 44 for securing to the ground surface.

The encasement 41 is preferably comprised of a flexible plastic material which becomes very slippery when a fluid such as water is applied thereto as with the upper sheet 20 and the lower sheet 50. The encasement 41 may be comprised of virgin polyethylene with a slip additive within. The encasement 41 may also be comprised of various blends of elastomer materials mixed within the polyethylene in order to improve its strength and resistance to tearing under various types of stresses. The encasement 41 could also be comprised of a vinyl material.

As best shown in FIGS. 1 and 3 of the drawings, the lower sheet 50 is an elongated structure similar to the upper sheet 20. The lower sheet 50 is preferably positioned beneath the transition member 40 for receiving an individual sliding upon the transition member 40.

The elongated lower sheet 50 is preferably comprised of a flexible plastic material which becomes very slippery when a fluid such as water is applied thereto. The elongated lower sheet 50 may be comprised of virgin polyethylene with a slip additive within. The lower sheet 50 may also be comprised of various blends of elastomer materials mixed within the polyethylene in order to improve its strength and resistance to tearing under various types of stresses. The lower sheet 50 could also be comprised of a vinyl material.

As best shown in FIG. 3 of the drawings, a plurality of securing loops 42 are attached to the lower sheet 50 and the encasement 41. A corresponding plurality of stakes 44 are extendable through the securing loops 42 for securing the lower sheet 50 to a ground surface.

Figure 5:
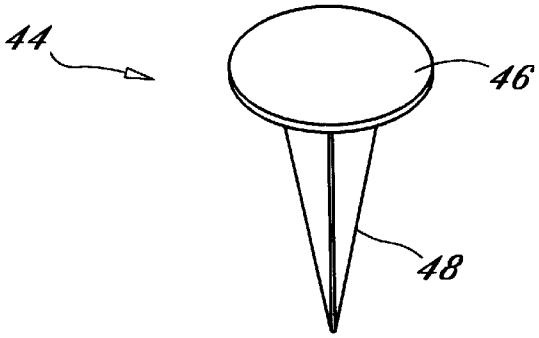
FIG. 5 is an upper perspective view of the stakes.

As best shown in FIG. 5 of the drawings, each of the stakes 44 are comprised of a head 46 and a shaft 48. The shaft 48 may have a plurality of partitions and edges extending there from. The head 46 is preferably a swaged member that can be easily engaged by a hammer or other blunt object.

As shown in FIG. 1 of the drawings, a plurality of gripping members 60 are provided that are attached to the upper surfaces of the steps 14 of the backyard slide 12 for preventing an individual from slipping upon the steps 14 during wet conditions. The gripping members 60 have a coarse upper surface that engages the individual's skin even during wet conditions. The underside of the gripping members 60 preferably is an adhesive that secures to the top of the steps 14.

In use, the user positions the upper sheet 20 upon the angled portion 16 of the backyard slide 12 and secures the securing straps 22*a–b* about the frame of the backyard slide 12. The user then positions the transition member 40 below the upper sheet 20 and attaches the fasteners 24. The user then positions the lower sheet 50 underneath the transition member 40 and applies stakes 44 to the securing loops 42. The water hose 18 is coupled to the delivery hose 34 and the water valve for the water hose 18 is opened thereby allowing pressurized water to flow through the delivery hose 34 into the water tubes 30*a–b* and the cross tube 36. The water continues through the water tubes 30*a–b* where it is dispersed through the nozzles 32 within the water tubes 30*a–b*. The water engages the surface of the upper sheet 20 and flows downwardly upon the encasement 41 of the transition member 40 and onto the lower sheet 50 making the surfaces extremely slippery. The individual climbs the steps 14 of the backyard slide 12 and positions their body upon the upper sheet 20. The downward force of gravity pulls the individual along the upper sheet 20 onto the transition member 40 and eventually slowing the individual down along the lower sheet 50. The individual may thereafter climb the backyard slide 12 again and repeat the entire process again. When the individual is finished utilizing the present invention, the upper sheet 20, transition member 40 and the lower sheet 50 are removed from the backyard slide 12 to allow conventional utilization of the backyard slide 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A water slide system, comprising:

a first sheet positionable within a channel of a backyard slide, wherein said first sheet is flexible; and a means for securing said first sheet to said backyard slide.

2. The water slide system of claim 1, wherein said first sheet is comprised of a material that becomes slippery when wetted.

3. The water slide system of claim 1, including a water supplying means for supplying water to said first sheet.

4. The water slide system of claim 3, wherein said water supplying means comprises at least one tube having at least one nozzle, wherein said at least one tube is fluidly connectable to a water hose.

5. The water slide system of claim 4, wherein said at least one tube is secured to said first sheet.

6. The water slide system of claim 1, including a second sheet positionable adjacent said first sheet, wherein said second sheet is positionable about a ground surface adjacent said backyard slide.

7. The water slide system of claim 6, including an attachment means for securing said second sheet to said ground surface.

8. The water slide system of claim 6, wherein said second sheet is comprised of a material that becomes slippery when wetted.

9. The water slide system of claim 6, including a transition member positionable between said first sheet and said second sheet for providing a smooth transition for a user sliding upon said first sheet and said second sheet.

10. The water slide system of claim 9, wherein an upper surface of said transition member is angled downwardly from said first sheet to said second sheet.

11. A water slide system, comprising:

a first sheet having a lower surface and an upper surface, wherein said first sheet is positionable within a channel of a backyard slide, wherein said first sheet is flexible;

a water supplying means for supplying water to an upper surface of said first sheet;

a means for securing said first sheet to said backyard slide; and a second sheet positionable adjacent said first sheet, wherein said second sheet is positionable about a ground surface.

12. The water slide system of claim 11, wherein said first sheet and said second sheet are comprised of a material that becomes slippery when wetted.

13. The water slide system of claim 11, wherein said water supplying means comprises at least one tube having at least one nozzle, wherein said at least one tube is fluidly connectable to a water hose.

14. The water slide system of claim 13, wherein said at least one tube is secured to said first sheet.

15. The water slide system of claim 11, including a transition member positionable between said first sheet and said second sheet for providing a smooth transition for a user sliding upon said first sheet and said second sheet.

16. The water slide system of claim 15, wherein said transition member includes a fastening means for removably securing said first sheet to said transition member.

17. The water slide system of claim 16, wherein an upper surface of said transition member is angled downwardly from said first sheet to said second sheet.

18. The water slide system of claim 16, wherein an upper surface of said transition member is curved.

19. The water slide system of claim 11, including an attachment means for securing said second sheet to said ground surface.

* * * * *